US005269073A

United States Patent [19]

Johnson

[11] Patent Number: 5,269,073

[45] Date of Patent: Dec. 14, 1993

[54] HAIR VACUUM APPARATUS

[76] Inventor: Lenard E. Johnson, 1913 S. 14th Ave., Broadview, Ill. 60153

[21] Appl. No.: 976,570

[22] Filed: Nov. 16, 1992

[51] Int. Cl.[5] ..... F26B 19/00

[52] U.S. Cl. ..... 34/60; 34/92; 34/96; 30/133

[58] Field of Search ..... 34/96, 97, 3, 92, 60, 34/61, 90, 12; 30/131, 132, 133, 41.6

[56] References Cited

U.S. PATENT DOCUMENTS

| | | | |
|---|---|---|---|
| 1,618,713 | 2/1927 | Kaufmann | 30/133 |
| 2,653,380 | 9/1953 | Atha | 30/133 |
| 2,697,876 | 12/1954 | Blanchard | 30/133 |
| 3,073,026 | 1/1963 | Schaedler | 30/133 |
| 3,279,023 | 10/1966 | Zobel | 30/133 |
| 4,216,581 | 8/1980 | Van Slooten | 30/133 |
| 4,628,601 | 12/1986 | Van Slooten | 30/133 |
| 4,843,717 | 7/1989 | Crane | 30/133 |

*Primary Examiner*—Henry A. Bennet
*Assistant Examiner*—Denise L. Gromada
*Attorney, Agent, or Firm*—Leon Gilden

[57] ABSTRACT

A vacuum structure arranged for mounted securement to an associated hair clipper assembly is provided in operative communication with a vacuum pump to direct severed and trimmed hair into an associated container. The apparatus includes a rigid air inlet housing arranged for mounting to the hair clipper assembly having a downwardly canted inlet nozzle to include a nozzle valve plate mounted to effect air flow into the nozzle.

2 Claims, 4 Drawing Sheets

HAIR VACUUM APPARATUS

BACKGROUND OF THE INVENTION

1. Field of the Invention

The field of invention relates to hair vacuum structure, and more particularly pertains to a new and improved hair vacuum apparatus wherein the same is arranged to direct cut hair into an associated receptacle container.

2. Description of the Prior Art

The prior art has heretofore utilized hair cutting structure in association with a vacuum arrangement as indicated in U.S. Pat. No. 4,380,870 to Otto, wherein a vacuum inlet port is arranged for communication with scissors to direct hair into a vacuum chamber, in a manner as similarly, set forth in U.S. Pat. No. 4,970,788 to Hunts. U.S. Pat. No. 4,005,526 and the U.S. Pat. No. 4,868,984 are further examples of hair cutter vacuum apparatus.

The instant invention attempts to overcome deficiencies of the prior art by employing a compact convenient structure readily arranged for mounting to a hair clipper assembly to direct cut hair into a receptacle container and in this respect, the present invention substantially fulfills this need.

SUMMARY OF THE INVENTION

In view of the foregoing disadvantages inherent in the known types of hair vacuum apparatus now present in the prior art, the present invention provides a hair vacuum apparatus wherein the same utilizes a rigid nozzle housing mounted to a hair clipper structure. As such, the general purpose of the present invention, which will be described subsequently in greater detail, is to provide a new and improved hair vacuum apparatus which has all the advantages of the prior art hair vacuum apparatus and none of the disadvantages.

To attain this, the present invention provides a vacuum structure arranged for mounted securement to an associated hair clipper assembly in operative communication with a vacuum pump to direct severed and trimmed hair into an associated container. The apparatus includes a rigid air inlet housing arranged for mounting to the hair clipper assembly having a downwardly canted inlet nozzle to include a nozzle valve plate mounted to effect air flow into the nozzle.

The invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair vacuum apparatus which has all the advantages of the prior art hair vacuum apparatus and none of the disadvantages.

It is another object of the present invention to provide a new and improved hair vacuum apparatus which may be easily and efficiently manufactured and marketed.

It is a further object of the present invention to provide a new and improved hair vacuum apparatus which is of a durable and reliable construction.

An even further object of the present invention is to provide a new and improved hair vacuum apparatus which is susceptible of a low cost of manufacture with regard to both materials and labor, and which accordingly is then susceptible of low prices of sale to the consuming public, thereby making such hair vacuum apparatus economically available to the buying public.

Still yet another object of the present invention is to provide a new and improved hair vacuum apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
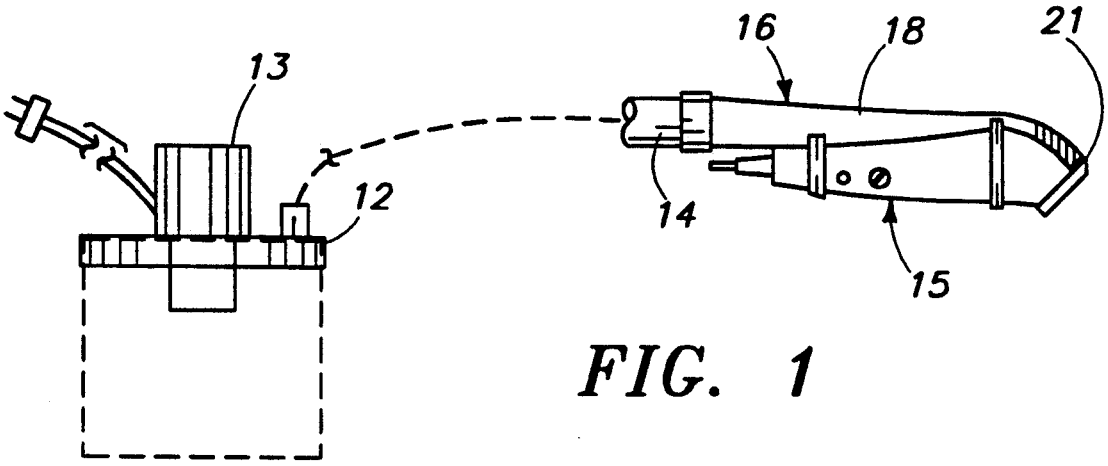
FIG. 1 is an orthographic side view of the invention.
Figure 2:
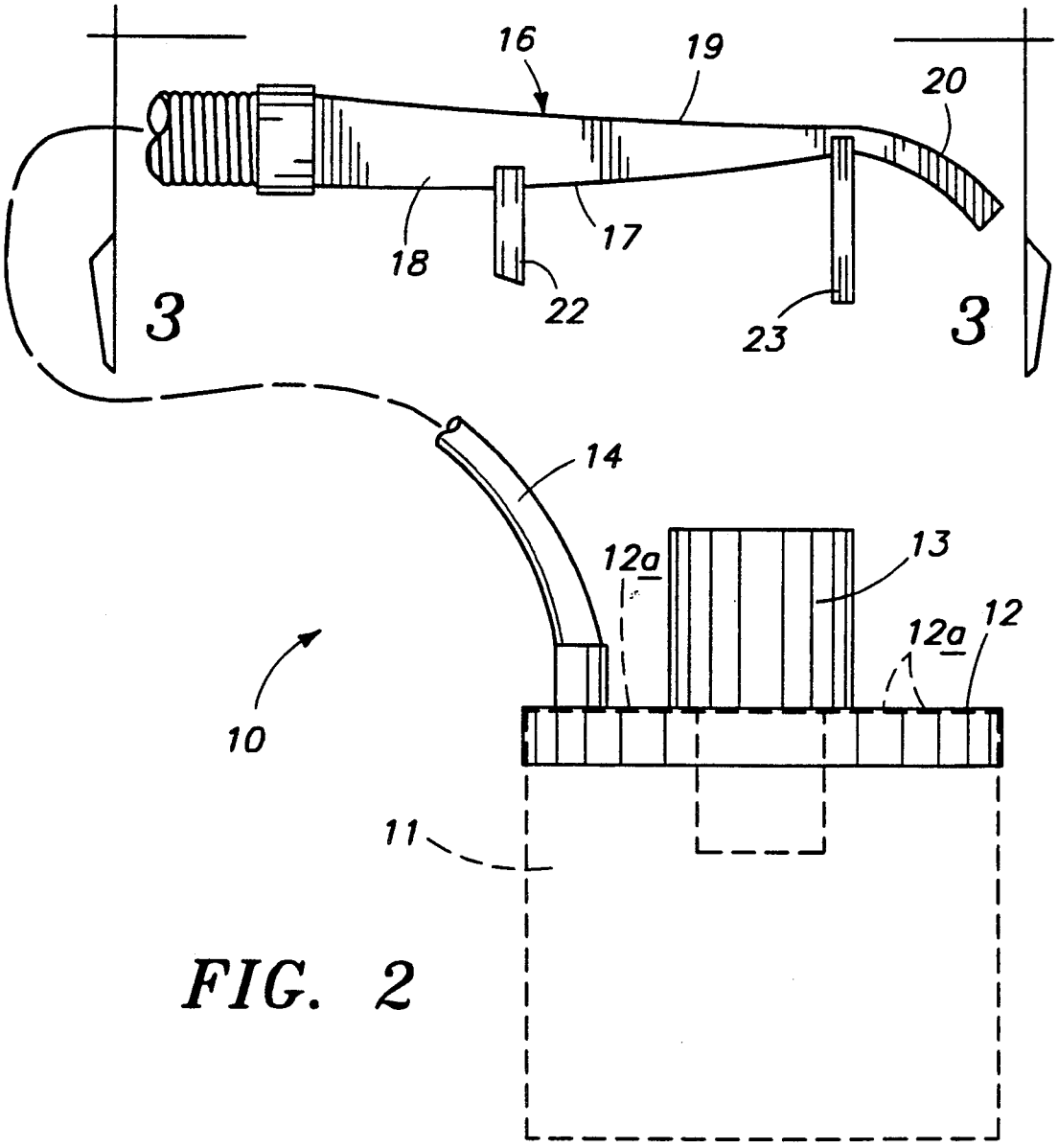
FIG. 2 is an enlarged orthographic side view of the invention.
Figure 4:
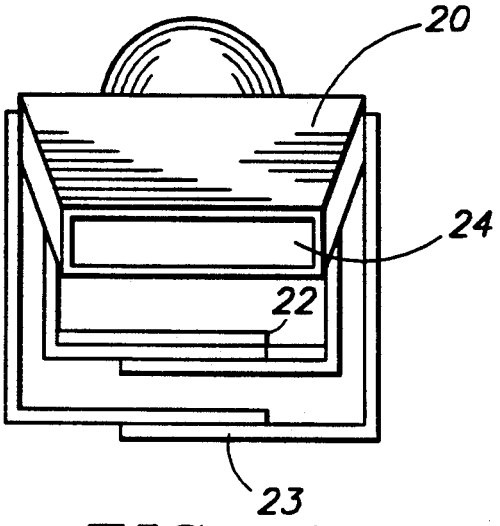
FIG. 4 is an orthographic view, taken along the lines 4—4 of FIG. 3 in the direction indicated by the arrows.
Figure 3:
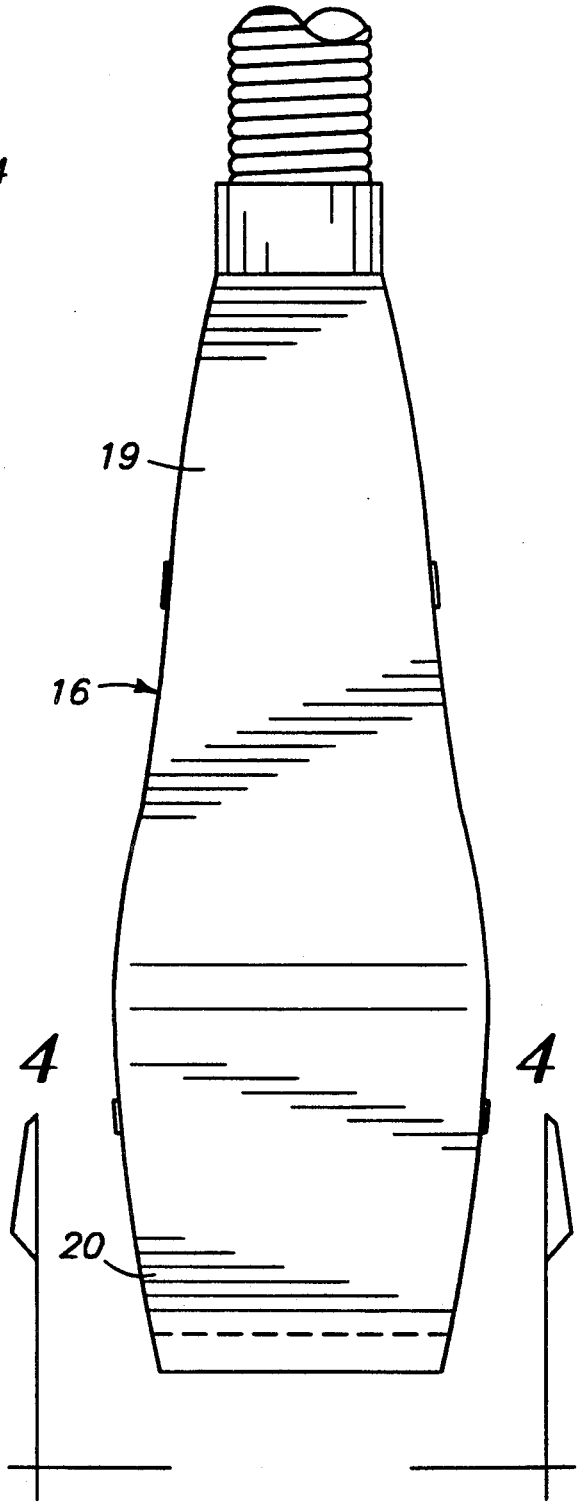
FIG. 3 is an orthographic view, taken along the lines 3—3 of FIG. 2 in the direction indicated by the arrows.
Figure 5:
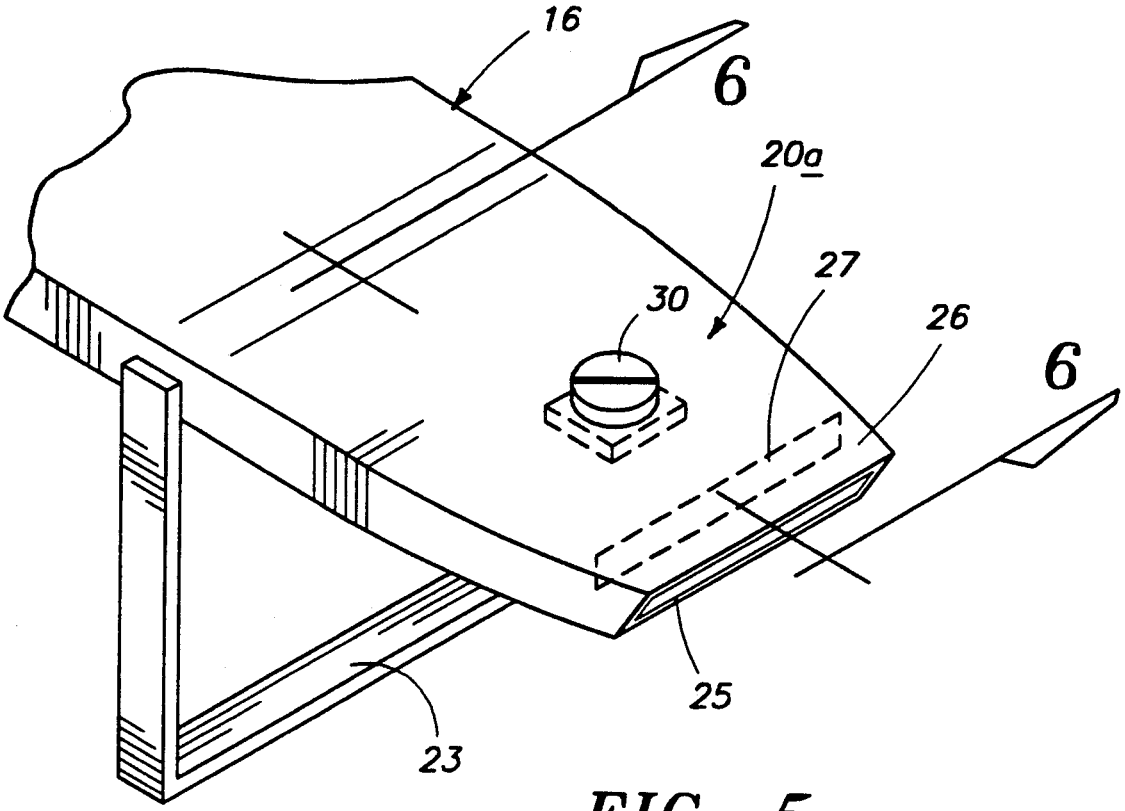
FIG. 5 is an enlarged isometric illustration of the nozzle structure of the inlet housing.
Figure 6:
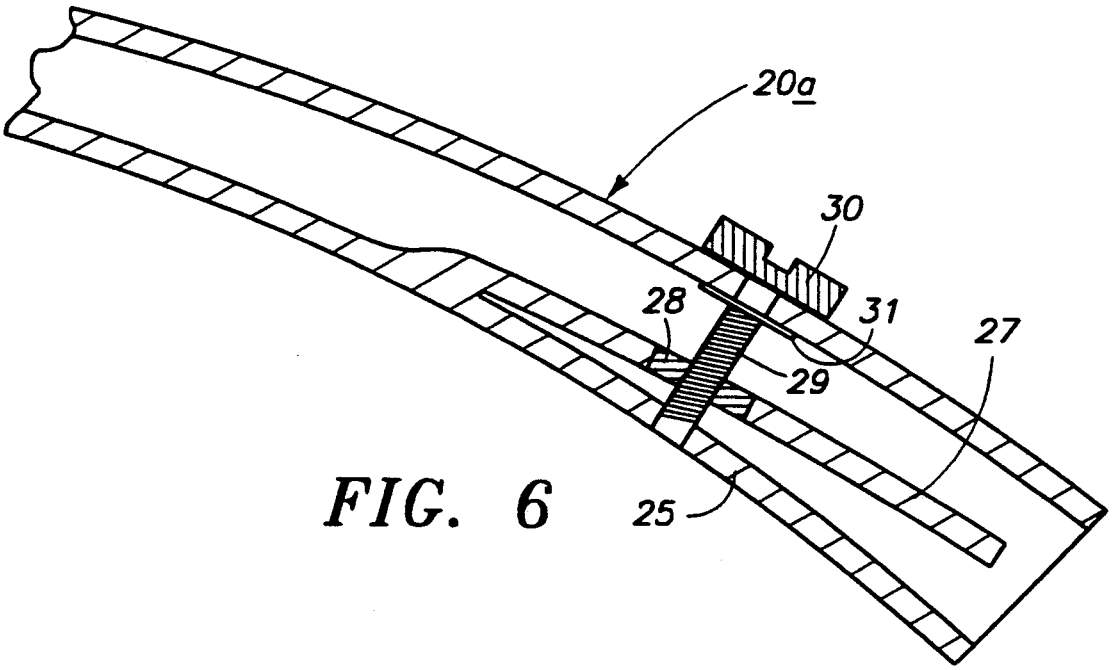
FIG. 6 is an orthographic view, taken along the lines 6—6 of FIG. 5 in the direction indicated by the arrows.

With reference now to the drawings, and in particular to FIGS. 1 to 10 thereof, a new and improved hair vacuum apparatus embodying the principles and concepts of the present invention and generally designated by the reference numeral 10 will be described.

More specifically, the hair vacuum apparatus 10 of the instant invention essentially comprises a receptacle container 11 having a container lid 12 arranged for securement to an upper end of the receptacle container 11, with the lid having a vacuum pump motor 13 mounted to the lid to effect a vacuuming of the receptacle container 11 and direct air therefrom through lid apertures 12*a* in the lid. A flexible pneumatic conduit 14 directs air into the lid, with the flexible pneumatic conduit 14 mounted at a first end to the lid and at a second end to a rigid air inlet housing 16 that in turn is arranged for securement to electrical hair clipper assembly 15, as indicated in FIG. 1. The hair clipper assembly 15 is formed with hair clipper cutter blades 21 in a conventional manner known in the prior art. The rigid air inlet housing 16 includes a housing floor 17, spaced housing side walls 13, and a housing top floor 19, with a housing inlet nozzle 20 mounted to a forward end of the air inlet housing 16, with the housing inlet nozzle 20 canted downwardly relative to the housing floor 17. A rearward end portion of the air inlet housing 16 includes the pneumatic conduit 14 directed thereto to direct air through the inlet nozzle 20, through the inlet housing 16, and into the conduit 14 for reception within the receptacle container 11. First and second strap pairs 22 and 23 are mounted to the housing side walls 17, with the first strap pair 22 including first and second strap members and the second strap pair 23 including third and fourth strap members, with the strap members arranged to utilize fasteners, such as hook and loop fastener portions or other suitable fastening structure to arrange mounting of the housing floor 17 into contiguous communication with the clipper assembly 15. The housing nozzle 20 is canted for orientation in adjacency to the hair clipper cutter blades 21 to direct severed hair directly into the nozzle structure 20. The nozzle 20 includes the nozzle inlet opening 24, with a nozzle valve plate 27 pivotally mounted within the nozzle onto the nozzle floor 25. The nozzle further includes a nozzle top wall 26 having a threaded adjuster rod 29 directed through the nozzle floor, having an adjuster rod head 30 to a top surface of the nozzle top wall 26, with a head plate 31 mounted to the adjuster rod to a bottom surface of the nozzle top wall 26 to capture rotatably the adjuster rod 29 relative to the nozzle top wall. The threaded adjuster rod 29 is directed through a threaded boss 23 that is fixedly mounted to the nozzle valve plate 27 to effect pivoting of the nozzle valve plate 27 within the housing nozzle 20, wherein the free end of the nozzle valve plate 27 effects selective restriction of air flow through the nozzle inlet opening 24 as the nozzle valve plate 27 is substantially coextensive between side walls of the nozzle 20.

Figure 7:
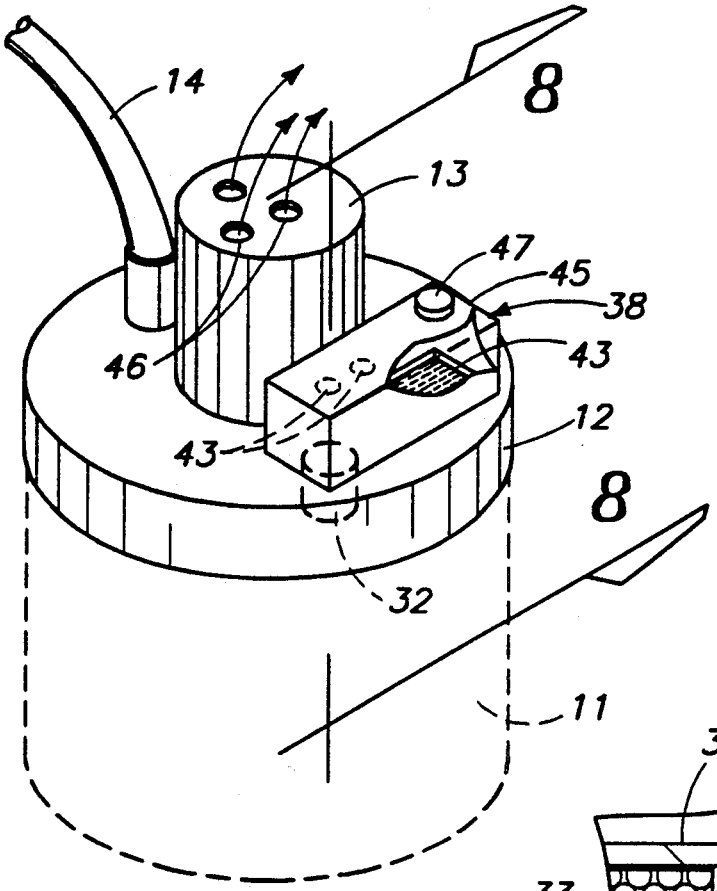
FIG. 7 is an enlarged isometric illustration of a modified receptacle container lid structure utilized by the invention.
Figure 9:
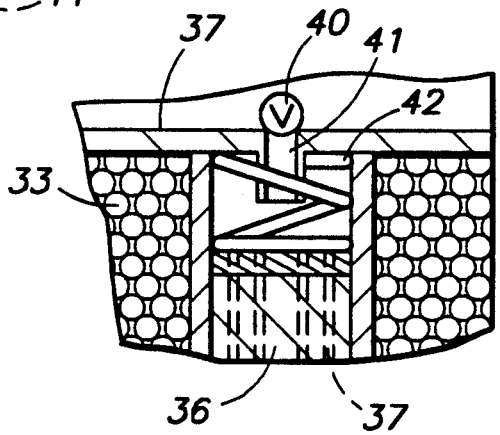
FIG. 9 is an enlarged orthographic view of section 9 as set forth in FIG. 8.
Figure 8:
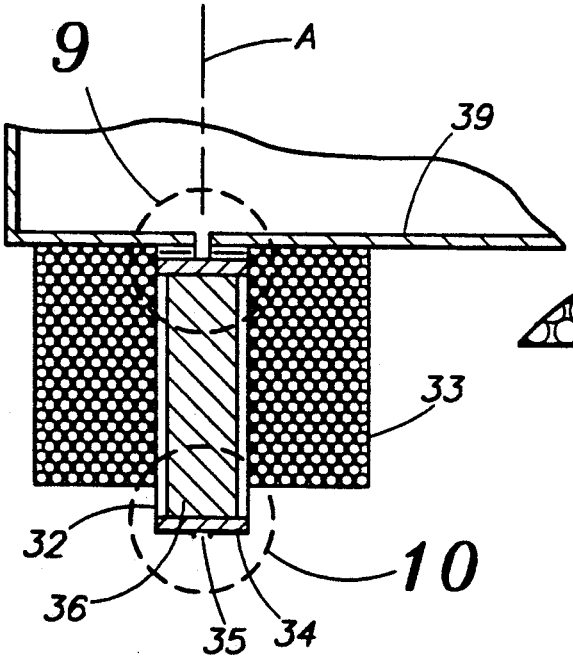
FIG. 8 is an orthographic view, taken along the lines 8—8 of FIG. 7 in the direction indicated by the arrows.
Figure 10:
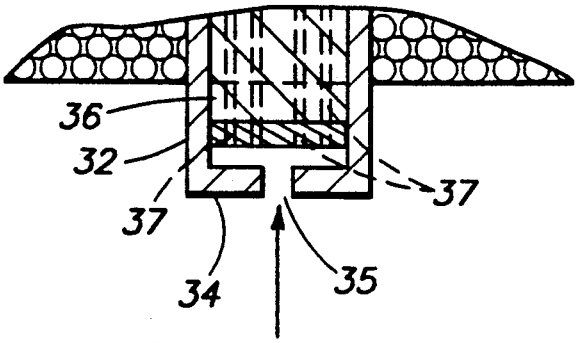
FIG. 10 is an enlarged orthographic view of section 10 as set forth in FIG. 8.

Further, the FIGS. 7-10 indicates the use of a modified lid structure having a reservoir housing 39 mounted to the lid, with the reservoir housing including a fill plug 47, with discharge apertures 44 directed through the lower housing into the vacuum pump. The reservoir housing floor 39 is mounted in contiguous communication to the lid. A housing floor conduit 41 is directed through the reservoir housing floor 39 into communication with a lid conduit cylinder 32 directing the exhaust air through the reservoir housing floor conduit 41, with a check valve 40 preventing fluid flow of an aromatic fluid 43 contained within the reservoir housing from entering the lid conduit cylinder 32. The lid conduit cylinder 32 includes an anhydrous member 33 arranged in surrounding relationship relative to the lid conduit cylinder 32, with the lid conduit cylinder 32 projecting below the lid 12, in a manner as indicated in FIG. 7. The lid conduit cylinder includes a cylinder floor 37 having a floor opening 35 medially of the floor. A cylinder valve 36 is reciprocatably mounted within the lid conduit cylinder, with the cylinder valve having cylinder valve conduits directed therethrough coaxially parallel relative to the cylinder extending coextensively therethrough. Each of the cylinder valve conduits 37 is coaxially spaced relative to a central axis "A", through the lid conduit cylinder 32, and the cylinder valve 36. The cylinder valve having a cylinder valve floor and a cylinder valve roof, with the cylinder valve conduits 37 directed from the floor to the roof, wherein a cylinder spring 42 is captured between the reservoir housing floor 39 and the cylinder valve roof of the cylinder valve 36. By use of the spring 42, the cylinder valve floor is in a first position in communication with the cylinder floor 34 in a sealing relationship. Upon vacuum pressurizing the container 11, discharge of such pressurized air is arranged to effect displacement of the cylinder valve floor from the cylinder floor 34, in a manner as indicated in FIG. 10. In this manner, air is discharged through the cylinder valve conduits 37 and through the aromatic fluid 43 by direction through the housing floor conduit 41 and cheek valve 40 into the reservoir outlet. The air in this manner directs aromatic fluid into the vacuum pump for discharge through the vacuum pump exit ports 46 within the vacuum pump housing for projection in a surrounding environment. Further, the discharge apertures 44 of the reservoir housing are positioned in adjacency to the reservoir housing top wall.

Typically, the vacuum pump structure of the invention may be of any conventional construction, wherein a blower motor organization such as indicated in U.S. Pat. No. 4,868,984 incorporated herein by reference may be typically employed to direct discharge through the vacuum pump exhaust ports 46 directing air flow through the reservoir housing from the pneumatic conduit 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair vacuum apparatus, comprising, a receptacle container, the receptacle container including a container lid, the container lid including a vacuum pump mounted to the lid, and a pneumatic conduit, the pneumatic conduit having a conduit first end mounted to the lid in pneumatic communication within the container below the lid, and the pneumatic conduit having a conduit second end, and a rigid air inlet housing having an outlet housing first end, with the pneumatic conduit second end directed into the air inlet housing first end, the inlet housing having an outlet housing second end, and the inlet housing second end including an inlet nozzle, with the housing having a housing floor spaced from a housing top wall and housing side walls, with the housing floor including the inlet nozzle canted relative to the housing floor, and the inlet housing including spaced inlet housing side walls, the side walls having first and second strap pairs mounted to the side walls, with a hair clipper assembly, with the hair clipper assembly arranged in contiguous communication with the inlet housing floor and first and second strap pair arranged for surrounding relationship relative to the hair clipper assembly, the hair clipper assembly including cutter blades, and wherein the inlet nozzle includes an inlet nozzle opening positioned in adjacency to the cutter blades, and the inlet nozzle includes an inlet nozzle floor and an inlet nozzle top wall, and a nozzle valve plate mounted pivotally within the inlet nozzle between the floor and the top wall, with the valve plate having a valve plate first end fixedly secured within the inlet nozzle to the nozzle floor, the nozzle valve plate having a threaded boss fixedly mounted to the valve plate, and an externally threaded adjuster rod directed through the nozzle top wall threadedly received within the threaded boss, the adjuster rod having an adjuster rod head positioned in adjacency to a top surface of the nozzle top wall, and the adjuster rod having an adjuster rod lock plate mounted to the adjuster rod fixedly thereto in adjacency to a bottom surface of the nozzle top wall, wherein rotation of the adjuster rod effects pivoting of the valve plate within the inlet nozzle.

2. An apparatus as set forth in claim 1 wherein the container lid includes a reservoir housing mounted to the lid in adjacency to the vacuum pump housing, the reservoir housing having a reservoir housing top wall, the reservoir housing top wall including a fill plug removably mounted thereto, and the reservoir housing including a reservoir housing floor, with an aromatic fluid contained within the reservoir housing between the housing floor and the housing top wall, and discharge apertures directed through the reservoir housing in adjacency to the reservoir housing top wall in communication with the vacuum pump housing, and a lid conduit cylinder fixedly, mounted to the lid positioned below the reservoir housing floor, with the lid conduit cylinder having a cylinder floor, the cylinder floor having a cylinder floor opening, and a cylinder valve positioned reciprocatably, within the lid conduit cylinder between the cylinder floor and the reservoir housing floor, and an axis, with the lid conduit cylinder and the cylinder valve symmetrically oriented about the axis, and the cylinder valve having a plurality of cylinder valve conduits parallel to and spaced from the axis, with the conduits arranged coextensively through the cylinder valve, and the cylinder valve having a cylinder valve floor and a cylinder valve top wall, with the cylinder valve arranged for sealing communication with the cylinder floor in a first position, and wherein the cylinder valve floor is spaced from the cylinder floor in a second position permitting air flow through the cylinder valve conduits, and a spring member mounted between the cylinder valve top wall and the reservoir housing floor to bias the cylinder valve in communication with the cylinder floor, and a housing floor conduit directed through the housing, floor in communication with the conduit cylinder above the cylinder valve top wall, and a check valve mounted to the cylinder valve conduit to prevent fluid flow from the reservoir into the lid conduit cylinder.

* * * * *